United States Patent [19]

Brand

[11] Patent Number: 4,795,663

[45] Date of Patent: Jan. 3, 1989

[54] FELT MEMBER AS A TECHNICAL ACCESSORY AND PROCESS AND APPARATUS FOR THE MANUFACTURE THEREOF

[76] Inventor: Jack Brand, 33 Harbour Square, Toronto, Ontario, Canada

[21] Appl. No.: 29,135

[22] Filed: Mar. 23, 1987

Related U.S. Application Data

[62] Division of Ser. No. 786,838, Oct. 11, 1985, Pat. No. 4,675,244.

[30] Foreign Application Priority Data

Oct. 19, 1984 [DE] Fed. Rep. of Germany ..... 3438381

[51] Int. Cl.[4] ..... B05D 1/18; B05D 3/02; C23C 14/00

[52] U.S. Cl. ..... 427/296; 118/50; 118/500; 427/389; 427/430.1

[58] Field of Search ..... 427/296, 389, 430.1; 118/50, 500

[56] References Cited

U.S. PATENT DOCUMENTS 3,533,834 10/1970 Marzocchi ..... 427/296

*Primary Examiner*—Michael Lusignan

*Attorney, Agent, or Firm*—Bachman & LaPointe

[57] ABSTRACT

A felt member, in particular a felt ring as a technical accessory for polishing and grinding operations, characterized in that the felt member contains at least 35% of a natural fiber material and polishing grains of a grain size of below 1000 μm are enclosed in cavities in the tangled structure of the natural fiber material.

17 Claims, 2 Drawing Sheets

Figure 1:
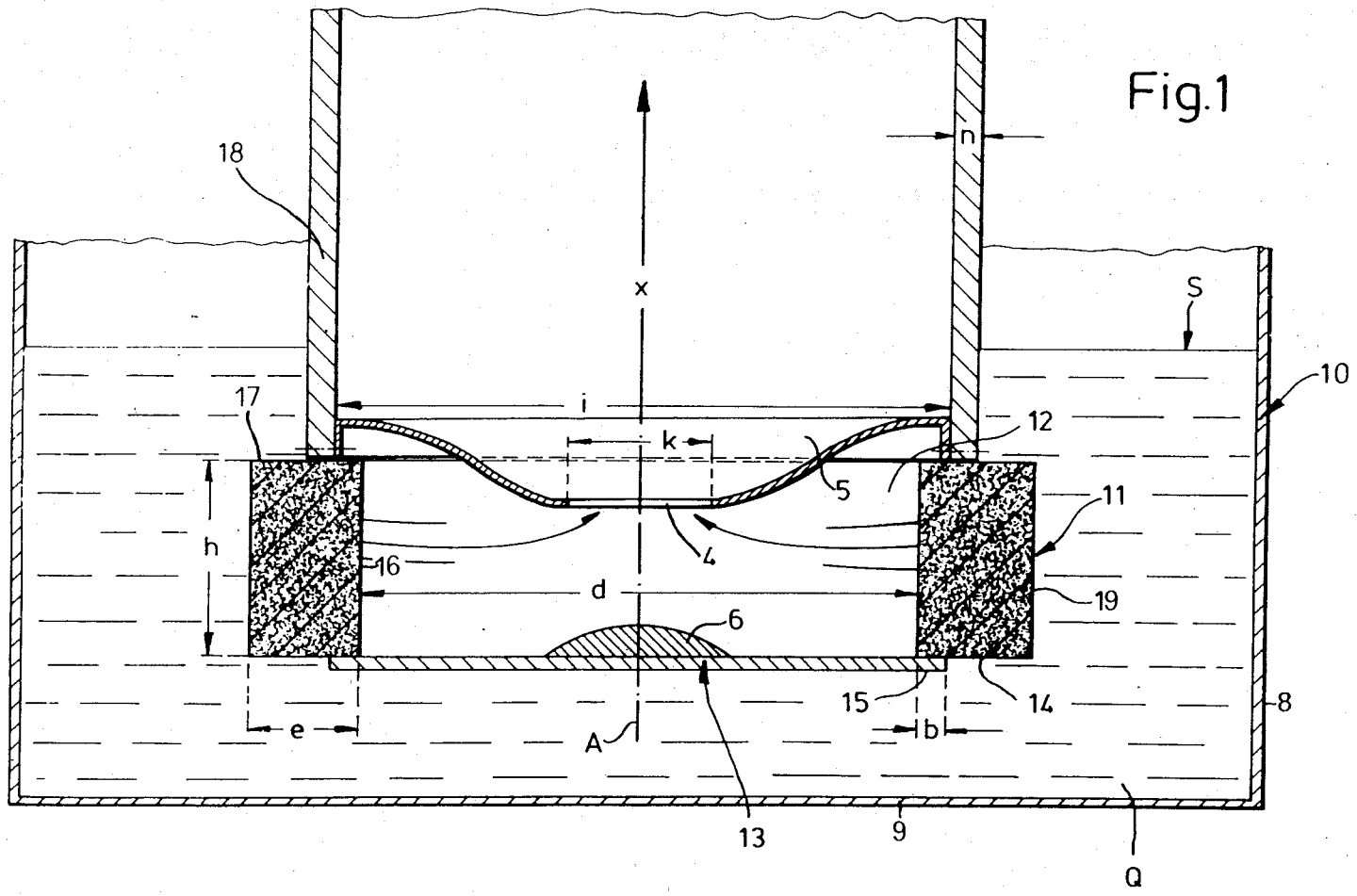

FELT MEMBER AS A TECHNICAL ACCESSORY AND PROCESS AND APPARATUS FOR THE MANUFACTURE THEREOF

This is a Division, of application Ser. No. 786,838 filed Oct. 11, 1985, now U.S. Pat. No. 4,675,744, patented June 23, 1987.

The invention relates to a felt member, in particular a felt ring, as a technical aid or accessory for polishing and grinding operations, and a process and apparatus for the manufacture thereof.

Felt discs or felt polishing members of the above-mentioned kind are usually produced from piece or lump felts, block felts, sheet felts or disc felts, in various thicknesses of from 1 millimeter to 150 millimeter, with diameters of from 1 millimeter to 1000 millimeters, more specifically either in the form of fulled or milled felts or in the form of felts which have not been fulled or milled, with specific weights of between 0.10 and 1.10 gr/cm$^3$.

The field of use of such felt discs includes grinding and polishing glass, metals, stones, wood and plastics material or the like, while abrasive grains comprising for example quartz, aluminum oxide or silicon carbide in a pasty carrier binder are disposed between the felt disc and a workpiece which is to be shaped by a cutting or material-removal action.

The advanatage enjoyed by felt, namely that it has a high capability of adapting itself to the material on which it is being used. Results in felt being used wherever there is a need for an elastically operative pressure and a particularly fine frictional effect for grinding and polishing. A disadvantage is the fact that felt can only be used with those grinding or polishing pastes, that is to say, after the application of particles to the surface of the felt member; there is no possibility of the abrasive grains being firmly bound into the felt; experience has shown that the felt is unable to retain the above-mentioned grinding or polishing additive materials.

Thus, the use of felt members and discs is limited, and solid abrasive members in the form of abrasive blocks or rings comprising ceramic materials, synthetic resins or rubber, are primarily used. Even the latter suffers from the disadvantage that, particularly in the case of glass grinding, it does not afford an adequate capability of adapting itself to provide close contact with the material to be ground.

Having regard to the foregoing considerations, the inventor set himself the aim of providing a felt member of the kind set forth in the opening part of this specification, which has an enhanced suitability for use in grinding and polishing operations, and also a process and apparatus for the manufacture thereof.

That object is achieved in that the felt member contains at least 35% of wool or like hair elements, and grinding or polishing grains of a grain size of up to 1000 μm are enclosed in the cavities in the tangled felt structure. Preferably, the proportion of the raw material for the felt member, which does not comprise wool or like hair elements, should amount to not more than 20% by volume, while the grain size of the inclusions is preferably less than 250 μm. a preferred embodiment of the felt member, in particular for the glass industry, is a felt ring having the above-indicated properties.

A necessary condition for manufacture of the felt member according to the invention therefore is the use, for forming a blank, of hollow fibres with a rough surface, in particular a surface which is of a flake-like or scale-like configuration; sheep's wool or other animal hair is preferably used. The addition of non-woollen or like non-hair fibres may fluctuate between 0% and 20%, depending on the quality and the specific weight of the resulting needled or milled felt produced.

The abrasive grains are held by the wool components, for example the scales or flakes thereof, even when the major part of the surface of the grains has been exposed, in the course of a grinding operation. In the case of the grinding stones which were conventionally used hitherto, the abrasive grain breaks out of the material surrounding it, as soon as only a small part of the surface of the abrasive grain was exposed from the material in which it was embedded. Thus, it is possible for abrasive grains to be introduced into the felt member, when the amount of wool is below the above-indicated limit value of 35%, but in that case the abrasive grains are thrown out by centrifugal effect, at low speeds of rotation. It is also in accordance with the invention for larger grains, for example up to 2500 μm, to be provided in the felt member, but such grains are generally unsuitable for grinding and polishing operations, but can be used for example in cube-like bodies or ball-shaped bodies of felt, in ball mill-like apparatuses.

The abrasive particles which preferably comprise cerium oxide are firmly disposed in cavities in the tangled fibre structure of the felt member, the hollow wool or hair elements of which are substantially positively held together by the described barb-like engagement effect for example of the flakes or scales on the wool or hair elements of the felt; during the process according to the invention, as described in greater detail hereinafter, the grinding particles slide into the cavities in the felt structure, after the wool components or the like have been made temporarily flexible. After a drying operation, the wool components, which are re-tightened, lock the abrasive particles in position.

The above-mentioned raw material comprising natural hair, possibly with the limited addition of foreign fibres, comprises about 10 to 95%, preferably 50 to 95% by weight of the finished felt member, with average air humidity. The specific weight thereof is between 0.50 and 1.00 g/cm3, possibly between 0.12 and 1.50 g/cm3.

The felt member according to the invention, in proportion to the sepcific weight of the finished accessory or technical aid, has from 80 to 1% and in particular from 35 to 1%, of polishing and grinding particles.

The process according to the invention is distinguished in that abrasive grains—cerium oxide is preferred for glass—are introduced into water, in a level of concentration of up to 500 g per liter of $H_2O$, preferably from 20 to 100 g, that mixture is pressed as a working fluid into a blank of the described configuration in accordance with the invention, and the pressed blank is then dried.

It has been found advantageous for the felt member to be treated with a substance which is referred to as a stiffness substance and which is added to the above-described mixture or which is subsequently introduced into the felt member. In that connection, an amount of stiffening additive materials in a range of up to 80%, preferably 40%, has been found to be advantageous. Suitable for that purpose are, in particular as water-soluble thermoplastic additives with a dry content of from 20 to 50%, polyvinyl or polyvinyl acetate dispersions, slightly viscous, non-ionogenic fluids, with a pH-value of between 3.5 and 6.0, with a specific weight of about 1.1 (20° C.). That stiffening additive appears in the form of a hard transparent coating on the finished article, after drying at preferably 80° C. to 120° C.

The working fluid is preferably used at from 1° to 80° C. (the denser the felt, the higher the temperature), for example, in the following compositions according to the invention, in each case with 1 liter of water:

| Cerium oxide ($Ce_2O_3$) | Additive |
|---|---|
| 20 to 60 g | 0.01 to 0.1 liter |
| 60 to 80 g | 0.01 to 0.25 liter |
| 100 g | 0.01 to 0.3 liter |

In accordance with the invention, the working fluid is introduced into the blank preferably at a temperature of from 1° C. to 80° C. by a reduced pressure which is applied thereto and by means of which the major part of the air present in the blank is removed and can be replaced by abrasive grains which penetrate thereinto.

However, it is also in accordance with the invention for atmospheric pressure or an increased pressure of up to 6 bars or more to be applied to the working fluid and the blank, on the condition that there is a pressure drop within the blank.

In accordance with a further feature of the process according to the invention, the blank may be prepared for receiving the grinding or polishing particles, by predominantly nonionogenic, weakly anion-active fatty acid ester compounds or the like; they produce surface smoothing of the fibres and cause them to go back into shape when a substantial amount of moisture is absorbed.

Apparatus for making the bond between the felt member and the grinding and polishing particles comprises a vessel for the working fluid, a holder which dips into the working fluid, for holding the felt member, and a conveyor conduit for a fluid pressure agent; the conveyor conduit is preferably in the form of a suction pipe of a vacuum pump, the inside diameter thereof in the production of a felt ring being slightly longer than the diameter of the opening in the ring. That feature, in conjunction with the further feature that a cover disc is provided for bearing against the underneath surface of the felt ring and bears against the underneath surface only over a negligible marginal portion, ensures a particularly intensive suction effect as well as a wide path for movement of the working fluid.

An apparatus according to the invention, which has a shaft portion above a fluid container, is used in particular for producing felt rings of larger size; that arrangement permits a dipping operation to be carried out during the rotary movement of the felt ring, a suction pipe or connection bearing against the felt ring in the dipping bath.

In another apparatus, the felt members are stacked in a pressure tank, air is removed therefrom in the tank, and the felt members are then exposed to the working fluid under pressure.

Figure 2:
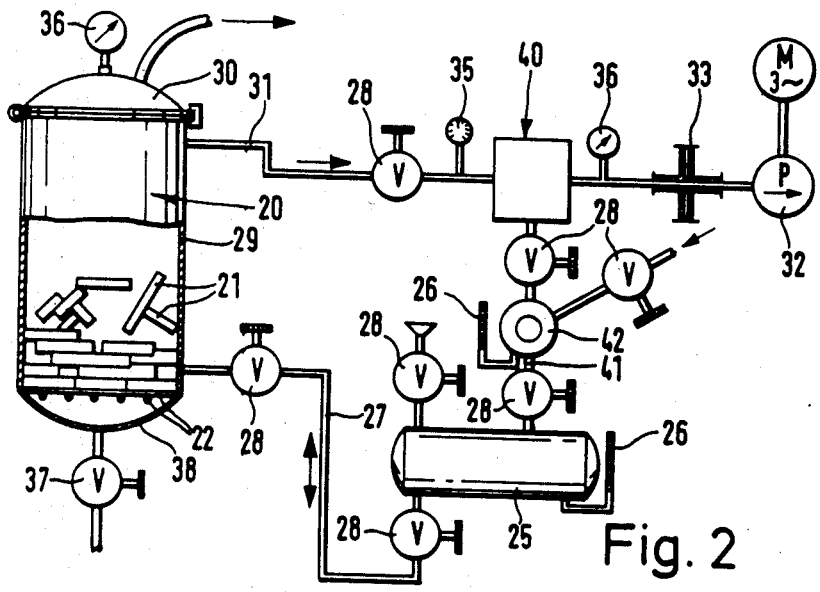
Figure 3:
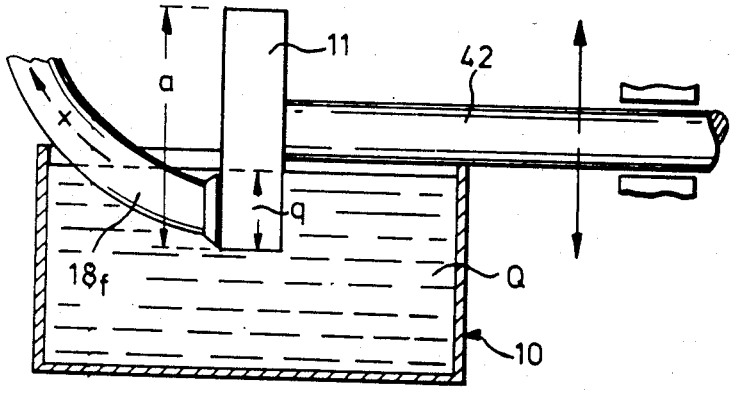

Further advantages, features and details of the invention will be apparent from the following description of preferred embodiments and with reference to the accompanying drawings which show diagrammatic views and in which:

FIG. 1 is a view in cross-section through a felt ring during a treatment process, FIG. 2 is a process flow chart, and FIG. 3 shows a further apparatus for treating a felt disc.

Referring to FIG. 1, disposed in a fluid container 10 at a spacing from the bottom 9 thereof and also from the wall 8 thereof is a felt ring 11. The height h of the felt ring 11 is for example 35 millimeters, while the diameter d of a central opening 12 in the ring is 110 millimeters, and the wall thickness e in the illustrated embodiment is 20 millimeters. The felt ring comprises a tangled fibre structure (which is not shown in the drawings), with an amount of natural hollow fibres. The amount of such natural hollow fibres will be referred to hereinafter. The hollow fibres in turn at least partially define cavities in the fibre structure.

Disposed below the opening 12 in the ring is a cover disc or plate 13 which covers over a bottom annular surface 14 over a narrow marginal portion 15 which is of the width indicated at b. The holder for the cover plate 13, which is preferably made of metal is not shown for the sake of clarity of the drawing.

By virtue of the cover plate 13, a working fluid Q which is disposed in the fluid container 10 and into which the felt ring 11 with cover plate 13 dips, does not at first reach the inside surfaces 16 of the felt ring 11.

Carried on the upwardly facing annular surface 17 of the felt ring 11 is a cylindrical pipe or connecting member 18 of small wall thickness as indicated at n (which is for example 5 millimeters), with an internal diameter as indicated at i of 110 millimeters in this embodiment.

The cylindrical connecting member 18 is connected to a vacuum pump (not shown in FIG. 1). When the vacuum pump is switched on, a suction air flow is produced in the direction indicated by the arrow x. That air flow causes working fluid Q to be drawn in through the felt ring 11 and into the opening 12 in the ring. As the working fluid Q passes through the cross-section of the felt ring from the upper and lower annular surfaces 17 and 14 thereof and from the outside 19 of the felt ring, to the inside surface 16 thereof, the abrasive grains in the working fluid Q, which comprise cerium oxide, $Ce_2O_3$, are removed from the working fluid Q and remain caught up in the above-described cavities in the felt ring. That produces a hard felt member with abrasive grains which are uniformly distributed over the entire cross-section of the ring and which, after a final treatment of the felt ring 11, are fixedly anchored therein so that the finished felt ring 11 is for example particulary suitable for the wet polishing of glass edges, by virtue of the fixed abrasive grains on the one hand and the limited elasticity of the felt fibre structure on the other hand.

In order to improve the flow conditions in the opening 12 in the ring, a part-spherical defelctor member 6 is centered on the cover plate 13 while fitted in the connecting member 18 is an insert 5 which is curved or displaced towards the cover plate 13, with a central suction opening 4 therein, by means of which the working fluid Q passes through the filter ring almost radially with respect to the axis A of the connecting member 18. The width of the suction opening 4 is indicated by k.

Referring now to FIG. 2, indicated therein at 20 is a pressure tank in which a plurality of felt discs 21 are supported on a grate 22. Connected to the tank 20 above the grate 22 is a conduit 27 with shut-off members 28, from a silo container 25 for working fluid Q which can be controlled by means of a level indicator 26.

Connected to the wall 29 of the pressure tank 20, adjacent a pressure lid or cover 30 thereof, is a conduit 31 of a vacuum pump 32 with a separator 40 which is connected between the tank and the pump. Provided in the conduit 31, besides shut-off members 28, are an inspection control or monitoring means 33, a thermometer 35 and a vacuum meter 36.

By means of the separator 40 residues of the working fluid Q are removed from a flow of air which is passed through the conduit 31; for the purposes of carrying away the residues removed from the flow of air, the separator 40 is connected to the container 25 by way of a conduit 41 and a vacuum trap 42.

The felt discs 21 are fitted into the above-described apparatus, and then the pressure cover or lid 30 is airtightly fitted into position thereon.

The shut-off members 28 in the conduit 27 are now closed and the shut-off member 28 of the conduit 31 is opened so that the tank can be evacuated when the vacuum pump 32 is switched on. The conduit 27 is then opened and the shut-off member 28 on the separator 40 is also opened, so that working fluid Q begins to pass through the felt discs 21.

After a period of time as set out below, the feed of working fluid Q is terminated and, after the reduced pressure produced in the pressure tank 20 has been eliminated. The pressure lid 30 of the tank 20 can be opened. Emptying the residual material in the tank, under atmospheric pressure, is effected by way of a shut-off member 37 at the bottom of the tank.

If one or more felt rings 11 of comparatively large diameter a are to be provided with cerium oxide or corresponding abrasive particles, the felt ring 11 may be gripped above a fluid container 10, on a shaft portion 42 which is movable perpendicularly to the axis of the shaft, as shown in FIG. 3. The means for mounting the felt ring 11 in position are not shown in the drawings. The felt ring 11 is dipped into the working fluid Q to a certain dipping depth as indicated at q; the working fluid Q is forced through the cross-section of the ring by means of a suction effect produced in a flexible suction pipe 18*f*.

An operation of treating the felt rings 11 is carried out, in accordance with the Example described below.

Block felt was used to produce blanks for making felt rings 11, of a height h of for example 40 to 60 millimeters. The dimensions were as follows:

| | |
|---|---|
| Outside diameter: | 150 mm |
| Inside diameter: | 110 mm |
| Wall thickness: | 20 mm. |

The specific weight was 0.48 to 0.68 g/cm3.

The opening 12 in the ring was bored while the blank was in the wet condition, and the outside wall 19 of the felt ring 11 was sawn.

The working fluid Q used comprised the following:

| Cerium oxide ($Ce_2O_3$) | Water ($H_2O$) | Additive (stiffening means) |
|---|---|---|
| 20 to 60 g | 1 liter | 0.1 liter |
| 60 to 80 g | 1 liter | 0.2 to 0.25 liter |
| 100 g | 1 liter | 0.3 liter. |

The above term 'cerium oxide' covers a mixture of high-grade cerium oxides, other oxides and additives which give a high-speed polishing agent of good mixability and moisture distribution. The physical and chemical data are as follows:

| | |
|---|---|
| Appearance: | Brown powder |
| average grain size: | 1.6 to 2.4 μm |
| pH-value: | 6.4 to 6.7 |
| loss on ignition: | about 5% |
| apparent density: | 1.1 to 1.4 |
| composition: | $CeO_2$ 55% |
| | other rare earth oxides 10% |
| | $Fe_2O_3$ 25% |
| starting concentration: | 10° Baume |
| | (1.074 specific weight or 100 g per liter) |

The mixture of $Ce_2O_3/H_2O$/additive was well stirred and the felt ring 11 with the sealing plate 13 was mounted to the suction pipe 18. The vacuum pump was then switched on and the felt ring was then fully immersed in the above-indicated mixture. After just 5 seconds approximately the felt ring 11 was turned and the operation was repeated from the other side in order to cause the cerium oxide to be uniformly distributed in the felt ring 11.

Following the suction operation, the water was centrifuged out in a centrifuge apparatus for about 60 seconds in order to speed up a subsequent drying operation. After the drying operation, the felt ring 11 was pressed to its finished dimensions and subjected to a stiffening or bracing process by saturating the pressed filter ring 11 with a stiffening or bracing additive as already referred to above.

The suction capability of the vacuum pump was in a range of from 80 to 100% vacuum suction efficiency while the working fluid Q was sucked through the felt ring 11; the lower the specific weight of the felt material, the lower must be the vacuum suction efficiency and the more $Ce_2O_3$ was absorbed.

Both the suction time and the amount of working fluid Q which is sucked through the felt member, of about 0.25 to 1 liter were dependent on the density of the felt, the height h of the felt blank, the concentration of the working fluid Q and the strength of the vacuum suction effect.

I claim:

1. A process for the manufacture of a felt member, in particular a felt ring as a technical accessory for polishing and grinding operations, which comprises providing a felt blank with at least 35% wool or the like hair elements and with a stiffening or bracing means added thereto, including abrasive grains introduced into water at a level of concentration of up to 500 grams per liter of water to provide a working fluid, dipping the blank into the working fluid, connecting the blank to a vacuum and subjecting the blank to said vacuum at one side thereof and pressing the working fluid into the blank, and drying the blank.

2. A process according to claim 1 wherein the concentration of abrasive grains in water is 20–100 grams per liter.

3. A process according to claim 1 characterised in that a pressure drop is produced within the blank for the felt member.

4. A process according to claim 3 characterised in that the pressure drop in the felt member is suddenly reversed.

5. A process according to claim 1 for the manufacture of a felt ring, characterised in that the opening in the ring is connected to a vacuum conduit and the oppositely disposed surface of the felt ring is covered in such a way that the working fluid is initially held outside the opening of the ring.

6. A process according to claim 1 characterised by a preferred range of subjecting the felt ring to vacuum, of from 10 to 1800 seconds.

7. A process according to claim 1 characterised in that the stiffening or bracing means is mixed with the working fluid before the blank is dipped therein.

8. A process according to claim 1 characterised in that the amount of stiffening or bracing additive material is in the range of up to 80%, preferably up to 40%.

9. A process according to claim 1 characterised by a water-soluble thermoplastic additive with a dry content of from 20 to 50%, preferably a polyvinyl or polyvinyl acetate dispersion.

10. A process according to claim 1 characterised in that an additive comprising predominantly non-ionogenic weakly anion-active fatty acid ester compounds is added to the felt member or the felt member blank before the working fluid is introduced.

11. Apparatus for the manufacture of a felt member, in particular a felt ring as a technical accessory for polishing and grinding apparatus, which comprises a felt blank with at least 35% wool or the like hair elements and with a stiffening or bracing means added thereto, a fluid vessel for holding a working fluid including abrasive grains introduced into water at a level of concentration of up to 500 grams per liter of water, a holder for holding the felt blank which can dip the felt blank into the working fluid, and conveyor conduit for a pressure fluid connected to the felt blank operative to subject the felt blank to a vacuum at one side thereof to press the working fluid into the blank.

12. Apparatus according to claim 11 characterised in that the conveyor conduit is a suction pipe of a vacuum pump.

13. Apparatus according to claim 11 for the manufacture of a felt ring characterised by a cover plate as a support for the felt ring.

14. Apparatus according to claim 11 characterised in that flow guide members for a working fluid are provided both on the cover plate and also at the suction pipe.

15. Apparatus according to claim 11 characterised in that the holder means for holding the felt ring comprises a shaft extending parallel to the surface of the fluid, and that the felt ring or felt member is to be secured to the shaft in such a way that it can dip into the working fluid.

16. Apparatus according to claim 15 characterised in that a suction connection is applied to a surface of the felt ring.

17. Apparatus according to claim 11 characterised by a pressure tank which is connected both to a fluid container and to a vacuum pump, wherein at least one separator is disposed between the vacuum pump and the pressure tank.

* * * * *